US006104234A

United States Patent [19]

Shin et al.

[11] Patent Number: 6,104,234

[45] **Date of Patent: *Aug. 15, 2000**

[54] SUBSTRATE VOLTAGE GENERATION CIRCUIT

[75] Inventors: Youn-Cherl Shin, Kyungki-do; Dae-Jeong Kim, Seoul, both of Rep. of Korea

[73] Assignee: LG Semicon Co., Ltd., Choongcheongbuk-do, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/997,088

[22] Filed: Dec. 23, 1997

[30] Foreign Application Priority Data

Dec. 30, 1996 [KR] Rep. of Korea ..... 96-77504

[51] Int. Cl.[7] ..... G05F 1/10

[52] U.S. Cl. ..... 327/535; 327/541; 327/534

[58] Field of Search ..... 327/534, 262, 327/281, 278, 277, 276, 541, 535; 365/226

[56] References Cited

U.S. PATENT DOCUMENTS

| | | | |
|---|---|---|---|
| 5,012,141 | 4/1991 | Tomisawa | 327/534 |
| 5,327,072 | 7/1994 | Savignac | 363/20 |
| 5,378,936 | 1/1995 | Kokubo et al. | 327/77 |
| 5,467,039 | 11/1995 | Bae | 327/198 |
| 5,506,540 | 4/1996 | Sakurai | 327/535 |
| 5,672,996 | 9/1997 | Pyeon | 327/534 |

*Primary Examiner*—Timothy P. Callahan
*Assistant Examiner*—Hai L. Nguyen

[57] ABSTRACT

An improved substrate voltage (VBB) generation circuit is disclosed. The circuit reduces variations in VBB (ΔVBB) caused by variations (ΔVCC) in a system voltage (VCC) by making a threshold voltage (Vt) of a logic element, e.g., an inverter of in a buffer, more sensitive to ΔVCC. In contrast, the conventional art had attempted to reduce ΔVBB by making the Vt of the logic element less sensitive to ΔVCC. Two features of the improved logic element of the circuit contribute to the reduction of ΔVBB. These features are: adopting an opposite channel ratio arrangement versus the conventional art; and incorporating additional active resistors.

24 Claims, 6 Drawing Sheets

SUBSTRATE VOLTAGE GENERATION CIRCUIT

FIELD OF THE INVENTION

The present invention relates to a substrate voltage generation circuit for a semiconductor device, and in particular to an improved substrate voltage generation circuit for a semiconductor device, e.g., a memory, which reduces substrate voltage variation by making the threshold voltage of a logic element in the voltage generation circuit more sensitive to variation in an external voltage.

BACKGROUND OF THE INVENTION

Generally, in a common type of semiconductor memory device, in particular, in a DRAM (Dynamic Random Access Memory), a substrate voltage having a relatively negative electric potential is generated and is applied to a substrate of the memory chip.

FIG. 1 is a circuit diagram illustrating a conventional substrate voltage generation circuit.

In FIG. 1, the conventional substrate voltage generation circuit includes: a substrate voltage detector 10, having loads L1 and L2 (such loads including transistors), that is connected in series between a supply voltage VCC and a substrate voltage VBB, and that outputs a divided voltage via a node N1; an inverter 11 for inverting the divided output voltage from the substrate voltage detector 10 and outputting the inverted voltage via a node N2; an inverter 12 for inverting the output voltage from the inverter 11 and outputting the inverted voltage via a node N3; an oscillator 13 for oscillating in accordance with the voltage output via the node N3 from the inverter 12; and a substrate voltage generator 14, driven by the oscillation signal from the oscillator 13, for applying the substrate voltage VBB, which is used for charge pumping, and which has a predetermined electric potential to the substrate voltage detector 10.

The inverter 11 includes PMOS transistors PM1 and PM2 and an NMOS transistor NM1 which are connected in series with one another.

The inverter 12 includes a PMOS transistor PM3 and an NMOS transistor NM2 which are connected in series with one another.

The operation of the conventional substrate voltage generation circuit will now be explained with reference to FIGS. 1 and 2.

The substrate voltage detector 10 divides the voltage difference between the supply voltage $V_{cc}$ and the substrate voltage VBB by the ratio of the loads L1 and L2 and applies the divided voltage to the node N1.

If the voltage of the node N1 is at a high level, the inverter 11 outputs a low level signal on the node N2, and the inverter 12 inverts this signal and applies a high level signal to the oscillator 13 through the node N3. In response to the high voltage on the node N3, the oscillator 13 becomes enabled, and the oscillation signal therefrom is applied to the substrate voltage generator 14.

In response to a high voltage on the node N3, the substrate voltage generator 14 decreases the substrate voltage VBB (which is used for a charge pumping). If the substrate voltage VBB reaches a predetermined level, the divided voltage at the node N1 becomes a low level, and the low level voltage is inverted by the inverters 11 and 12 in turn and is applied as a low level voltage to the oscillator 13 through the node N3. Thereafter, the oscillation operation of the oscillator 13 is stopped by the low level voltage inputted thereinto.

In the inverter 11, the PMOS transistor PM2 (the gate of which is connected to ground so that PM2 is always turned on), acts as a resistor. So, when the PMOS transistor PM1 is turned on, the current at the node N2 is limited by the active resistor PM2.

The inverters 11 and 12 act as a buffer, so that the electric potential of the node N1 is slowly varied based on the variation of the supply voltage $V_{cc}$ or the substrate voltage VBB.

FIG. 2 is a graph illustrating the variation of the substrate voltage VBB in accordance with a supply voltage $V_{cc}$ variation in the circuit as shown in FIG. 1.

As shown therein, reference character "a" denotes a variation range of the supply voltage $V_{cc}$, "b" denotes the variation range of a threshold voltage for the inverter 11, and "e" denotes an enabling time of the oscillator based on the variation of the supply voltage $V_{cc}$.

Namely, in a state that the voltage $V_{cc}$ has a high electric potential, if the substrate voltage VBB is increased from −2v to 0v, the electric potential of the node N1 is varied as indicated by the curve N1' in FIG. 2, the electric potential of the node N3 is varied as indicated by the line N3', and the logic threshold voltage of the inverter 11 is varied as indicated by the line VT'. The electric potential of the nodes N2 and N3 are inverted at the point "A" between the line VT' of the inverter 11 and the line N3' of the node N3, for thus enabling the oscillator 13, and the substrate voltage generator 14 is driven, and the level of the substrate voltage VBB decreases to a substrate voltage VBB' corresponding to the point "A".

In addition, in a state that the voltage $V_{cc}$ has a low electric potential, if the substrate voltage VBB is increased from −2 v to 0 v, the electric potential of the node N1 is varied as indicated by the curve N1", and the electric potential of the node N3 is varied as indicated by the line N3", and the logic threshold voltage of the inverter 11 is varied based on the line VT". At this time, the substrate voltage generator 14 is driven at the point "B", and the level of the substrate voltage VBB decreases to the substrate voltage VBB" corresponding to the point "B".

When the voltage $V_{cc}$ is varied, the oscillator 13 and the substrate voltage generator 14 become activated differently thus varying the level of the resulting substrate voltage VBB. However, the variation range "e" of the substrate voltage VBB, as shown in FIG. 2, is largely and disadvantageously dependent on the voltage $V_{cc}$.

The voltage VBB is used to bias the substrate for NMOS transistors. When VBB varies (ΔVBB), this can cause the speed of a device employing NMOS transistors to speed up or slow down, both of which can cause the device to malfunction. Thus, it is of great importance to minimize ΔVBB.

The conventional art attempted to make VBB insensitive to changes in VCC (ΔVCC) by making the logic threshold Vt of the buffer (formed from the inverters 11 and 12) insensitive to ΔVCC. More particularly, the conventional art made the logic threshold of the inverter 11, Vt(11), insensitive to ΔVCC. This is depicted by the curve 50 of FIG. 5, which represents the relation between VCC and the logic threshold voltage of the particular embodiment of the conventional inverter 11*a* of FIG. 6. The inverter 11*a* differs from the inverter 11 by not having the active resistor PM2, and by having explicit channel dimensions and a channel dimension ratio (channel width:channel length) for each of the transistors.

The channel dimensions for the transistors of the inverter 11*a* of FIG. 6 are: PM1, 3 μm in width, 45 μm in length, for a ratio of 1:15; and NM1, 15 μm in width, 3 μm in length, for a ratio of 5:1. The Vt(11*a*) is approximately Vt (NM1). As a result, the curve 50 is very flat over the range of about 2 to 5 volts. In other words, Vt(11*a*) is very much insensitive to ΔVCC. Unfortunately, having Vt(11*a*) that is insensitive to ΔVCC exaggerates ΔVBB.

SUMMARY OF THE INVENTION

Accordingly, it is an object of the present invention to provide a substrate voltage generation circuit for a semiconductor device, e.g., a memory, which overcomes the aforementioned problems encountered in the conventional art.

It is another object of the present invention to provide an improved substrate voltage generation circuit for a semiconductor memory device which reduces substrate voltage variation by making the threshold voltage of a logic element, e.g., an inverter in a buffer, of the substrate voltage generation circuit more sensitive to variation in an external voltage, e.g., VCC, than the conventional art.

These and other objects of the present invention are achieved by providing an improved substrate voltage (VBB) generation circuit. This circuit reduces variations in VBB (ΔVBB) caused by variations (ΔVCC) in a system voltage (VCC) by making a threshold voltage (Vt) of a logic element, e.g., an inverter of in a buffer, more sensitive to ΔVCC. In contrast, the conventional art had attempted to reduce ΔVBB by making the Vt of the logic element less sensitive to ΔVCC. Two features, which can be used together or independently, of the improved logic element of the circuit contribute to the reduction of ΔVBB. These features are: adopting an opposite channel ratio arrangement versus the conventional art; and incorporating additional active resistors. The opposite channel arrangement vis-a-vis the conventional art involves making the conductances of the transistors in the inverter similar instead of making them dissimilar.

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 3:
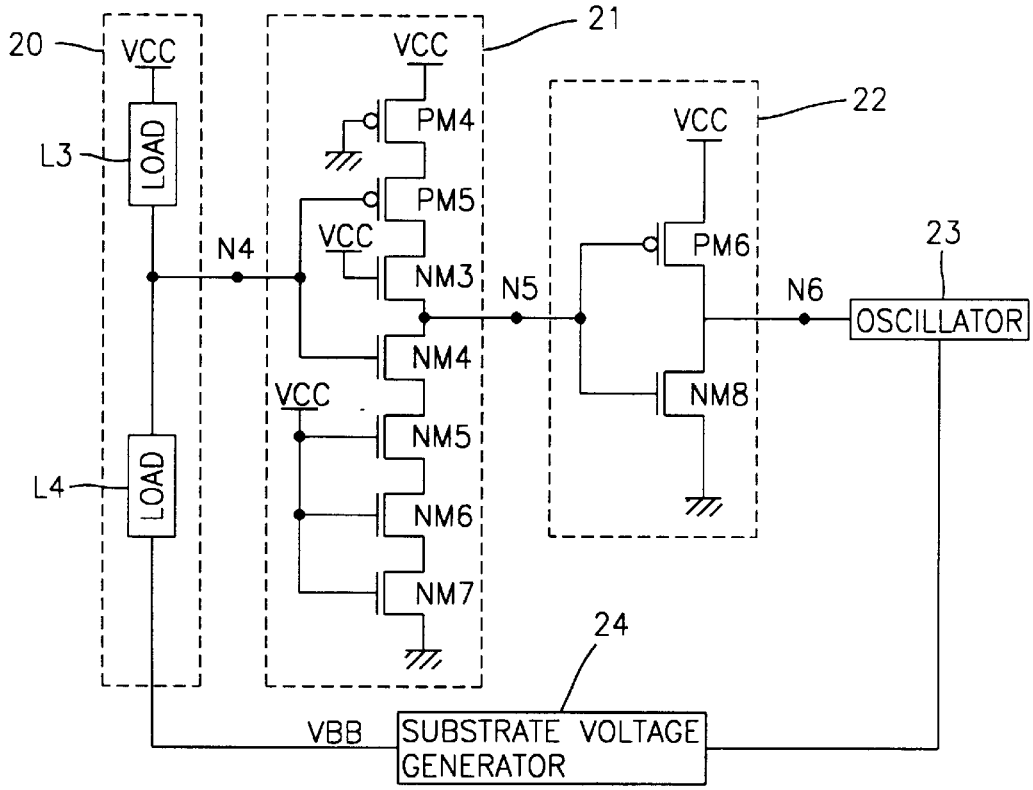
FIG. 3 is a schematic circuit diagram illustrating a substrate voltage generation circuit for a semiconductor memory device according to the present invention.

FIG. 3 is an exemplary schematic circuit diagram illustrating a substrate voltage generation circuit for a semiconductor memory device according to the present invention.

In FIG. 3, the substrate voltage generation circuit for a semiconductor memory device according to the present invention includes: a substrate voltage detector 20 having loads L3 and L4 connected in series between a supply voltage $V_{cc}$ and a substrate voltage VBB, and for outputting a divided voltage via a node N4; a CMOS inverter 21 for inverting the voltage output from the substrate voltage detector 20, for outputting the inverted voltage via a node N5, the threshold voltage of which varies in accordance with the electric potential of the supply voltage $V_{cc}$; a CMOS inverter 22 for inverting the voltage output from the inverter 21 and outputting the inverted voltage via a node N6; an oscillator 23 for oscillating in accordance with the voltage output from the inverter 22; and a substrate voltage generator 24, driven by the oscillation signal from the oscillator 23, for applying the substrate voltage VBB, which is used for a pumping charge to the substrate voltage detector 20.

The inverter 21 includes: a PMOS transistor PM4 the source of which receives the supply voltage $V_{cc}$, and the gate of which is connected to ground; a PMOS transistor PM5 the source of which is connected with the drain of the PMOS transistor PM4 and the gate of which is connected with the node N4; an optional NMOS transistor NM3 the source of which is connected with the drain of the PMOS transistor PM5, the gate of which receives the supply voltage $V_{cc}$ and the source of which is connected with the node N5; an NMOS transistor NM4 the drain of which is connected with the source of the NMOS transistor NM3 (i.e., the node N5) and the gate of which is connected with the node N4; and NMOS transistors NM5, NM6, and NM7 (of which NM5 and NM6 are optional) which are connected in series between the source of the NMOS transistor NM4 and ground and which receive the supply voltage $V_{cc}$ at their gates, respectively.

The inverter 22 includes a PMOS transistor PM6 and an NMOS transistor NM8, which are connected in series with each other between $V_{cc}$ and ground, and which have their gates commonly connected with the node N5.

Figure 1:
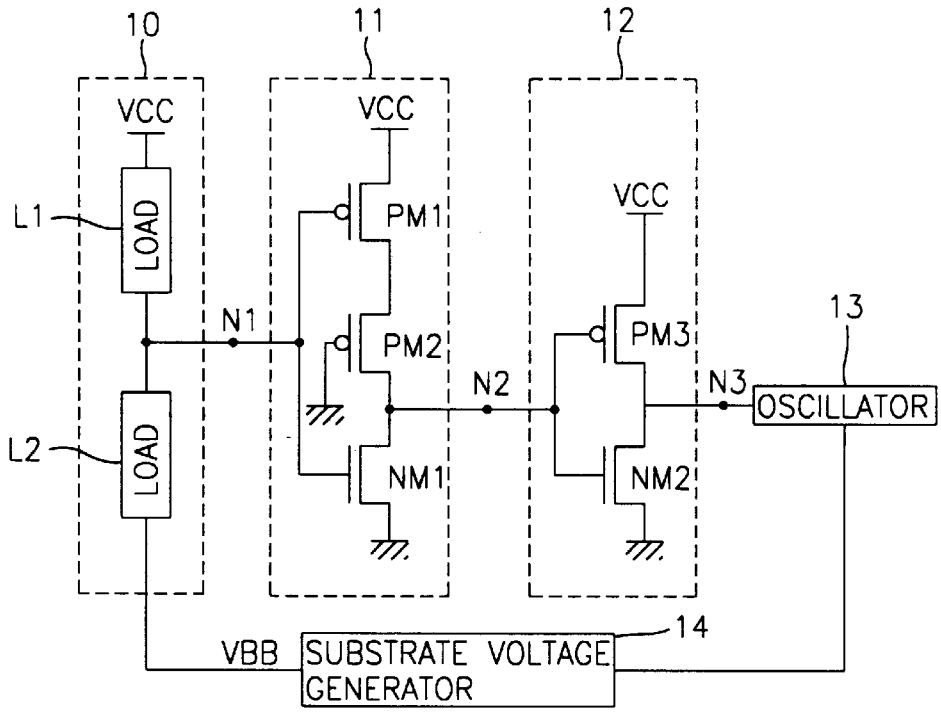
FIG. 1 CONVENTIONAL ART
FIG. 1 is a schematic circuit diagram illustrating a conventional substrate voltage generation circuit.

The oscillator 23 and substrate voltage generator 24 are identical to those in the conventional circuit of FIG. 1.

The operation of the substrate voltage generation circuit according to the present invention will now be explained with reference to FIGS. 3 and 4.

The divided output voltage appearing at node N4, the level of which is determined by the ratio between the loads L3 and L4 connected between the voltage VCC and the substrate voltage VBB. The voltage level at the node N5 is determined by the logic threshold voltage of the inverter 21.

The PMOS transistor PM4 of the inverter 21 is always turned on and acts as a resistor which limits the current based on the voltage $V_{cc}$. In addition, the NMOS transistor NM3 is also always turned on and also acts as a resistor.

The gates of the NMOS transistors NM5, NM6, and NM7 are connected in series with the NMOS transistor NM4 and receive the voltage $V_{cc}$ on their gates. The series connected NMOS transistors NM5–NM7 are used as an MOS resistor having a resistance value which varies in accordance with the variation of the supply voltage $V_{cc}$. Therefore, if the voltage $V_{cc}$ is increased, the threshold voltage of the inverter 21 is increased. On the contrary, when the supply voltage $V_{cc}$ is decreased, the logic threshold voltage of the inverter 21 is decreased.

Figure 4:
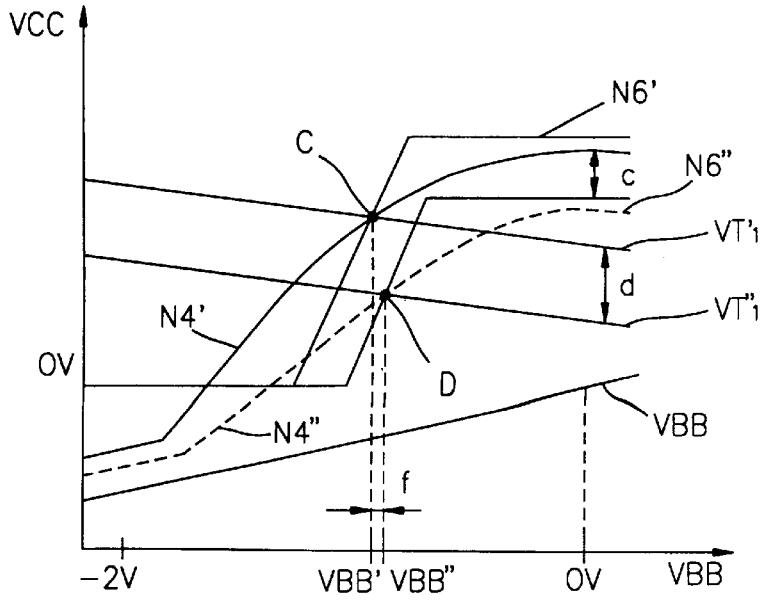
FIG. 4 is a graph illustrating the variation in a substrate voltage in accordance with a supply voltage variation in the circuit as shown in FIG. 3 according to the present invention.

FIG. 4 is an exemplary graph illustrating the variation in the substrate voltage in accordance with a supply voltage variation in the circuit as shown in FIG. 3 according to the present invention. In a state that the supply voltage $V_{cc}$ is at a high level, the electrical potential at the node N4 is varied as indicated by the curve N4', and the electrical potential at the node N6 is varied as indicated by the line N6'.

When VCC is at the high level, the inverters 21 and 22, respectively, invert their input voltage signals at the point "C", which is the intersection of the electrical potential of the nodes N4 and N6 and the logic threshold voltage VT1' of the inverter 21.

Since the voltage of the point "C" corresponding to the electrical potential at the node N6 is at a high level, the oscillator 23 is enabled to oscillate, and the substrate voltage generator 24 is driven by the oscillation frequency, and then the electrical potential of the substrate voltage VBB decreases to the substrate voltage VBB'. Here, the VBB decreases from 0V to −2V.

In a state that the supply voltage $V_{cc}$ is at a low level, the electrical potential at the node N4 is varied as indicated by the curve N4", and the electrical potential at the node N6 is varied as indicated by the line N6".

When VCC is at the low level, the inverters 21 and 22, respectively, invert their input voltage signals at the point "D" denoting the point of intersection between the electrical potentials of the nodes N4" and N6" and the logic threshold voltage VT1" of the inverter 21.

Since the voltage at the point "D" corresponding to the electrical potential at the node N6 is at a high level, the oscillator 23 is enabled to oscillate, and the substrate voltage generator 24 is driven by the oscillation frequency, and then the electrical potential of the substrate voltage VBB increases to the substrate voltage VBB". Here, e.g., VBB increases from −2V to 0V.

In the drawings, reference character "c" denotes the variation range of the voltage $V_{cc}$, "d" denotes the variation range of the logic threshold voltage of the inverter 21, and "f" denotes an enabling time of the oscillator 23 based on the variation of the voltage $V_{cc}$.

Figure 2:
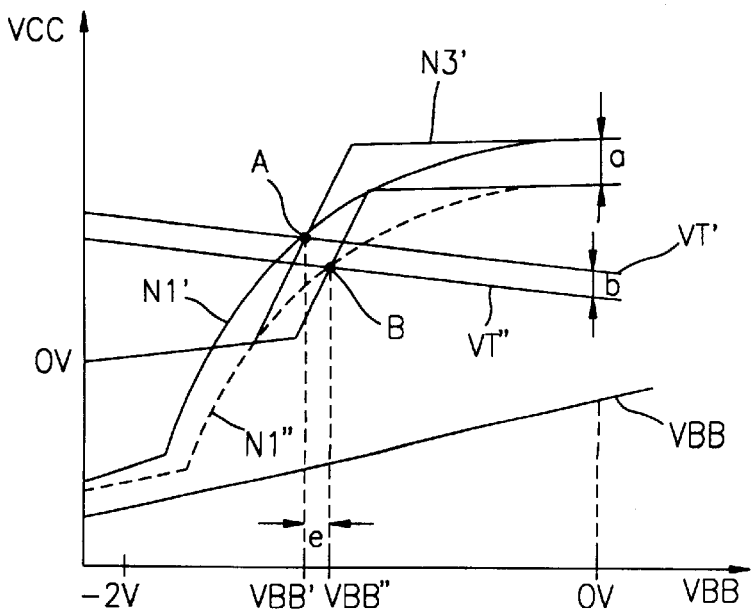
FIG. 2 CONVENTIONAL ART
FIG. 2 is a graph illustrating the variation in a substrate voltage in accordance with a supply voltage variation in the circuit as shown in FIG. 1.

The electrical potential at the node N4 is unavoidably varied based upon variations in the voltage $V_{cc}$, and so the logic threshold voltage of the inverter 21 is greatly varied, e.g., compare range d of FIG. 4 against range b of conventional art FIG. 2. Yet the substrate voltage VBB' is approximately equal to VBB" (for the points "C" and "D"). Therefore, it is possible to obtain a more stable substrate voltage VBB with respect to the variation of the supply voltage $V_{cc}$.

As described above, the substrate voltage generation circuit for a semiconductor memory device according to the present invention includes a logic element, e.g., an inverter of a buffer, whose threshold voltage varies in accordance with variations of the supply voltage VCC, thus generating a more stable substrate voltage.

There are two features of the embodiment of FIG. 3 that contribute to the reduction of ΔVBB. These features are: adopting an opposite channel ratio arrangement vis-a-vis the conventional art; and incorporating additional active resistors. These features will be further explained by referring to FIGS. 7–9 and FIG. 5.

Figure 7:
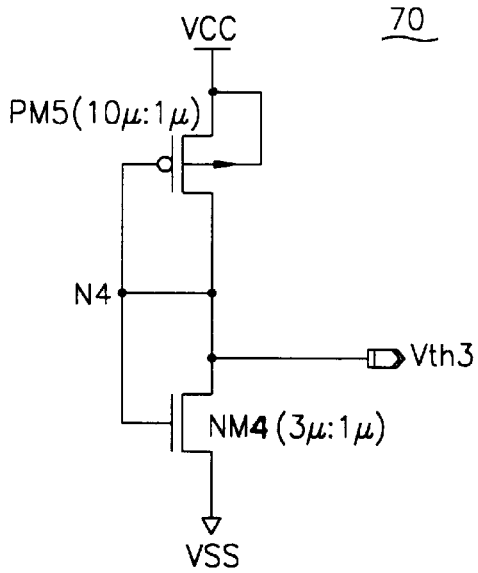
FIGS. 7–9 depict embodiments of inverters according to the voltage generation circuit of the present invention whose logic threshold voltage plots are depicted in FIG. 5, respectively.

FIG. 7 illustrates the feature of adopting an opposite channel ratio arrangement for the inverter of the buffer vis-a-vis the conventional art. FIG. 7 illustrates a version 70 of the inverter 21 of FIG. 3. The inverter 70 differs from the inverter 21 by having only the transistors PM5 and NM4. The channel dimensions for these transistors are: PM5, 10 μm in width, 1 μm in length, for a ratio of 10:1; and NM4, 3 μm in width, 1 μm in length, for a ratio of 3:1. Here, the ratio for the PMOS transistor has changed from 1:15 of PM1 of the conventional art to 10:1 of PM5. Also the ratio of the NMOS transistor has changed from 5:1 for NM1 to 3:1 for NM4.

Figure 5:
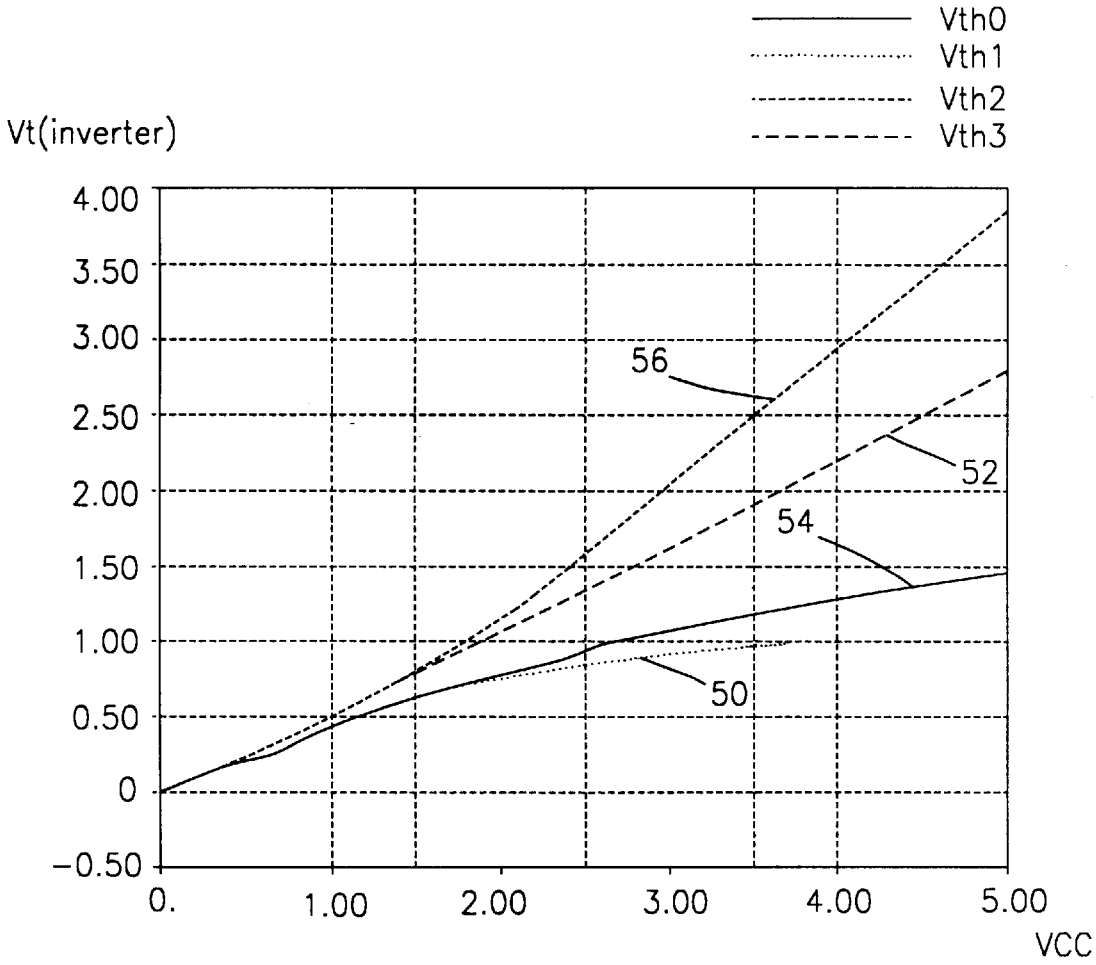
FIG. 5 depicts four plots of system voltage VCC versus inverter threshold voltage Vt, with one of the plots corresponding to the conventional art while three of the plots correspond to the embodiments of the present invention.
Figure 6:
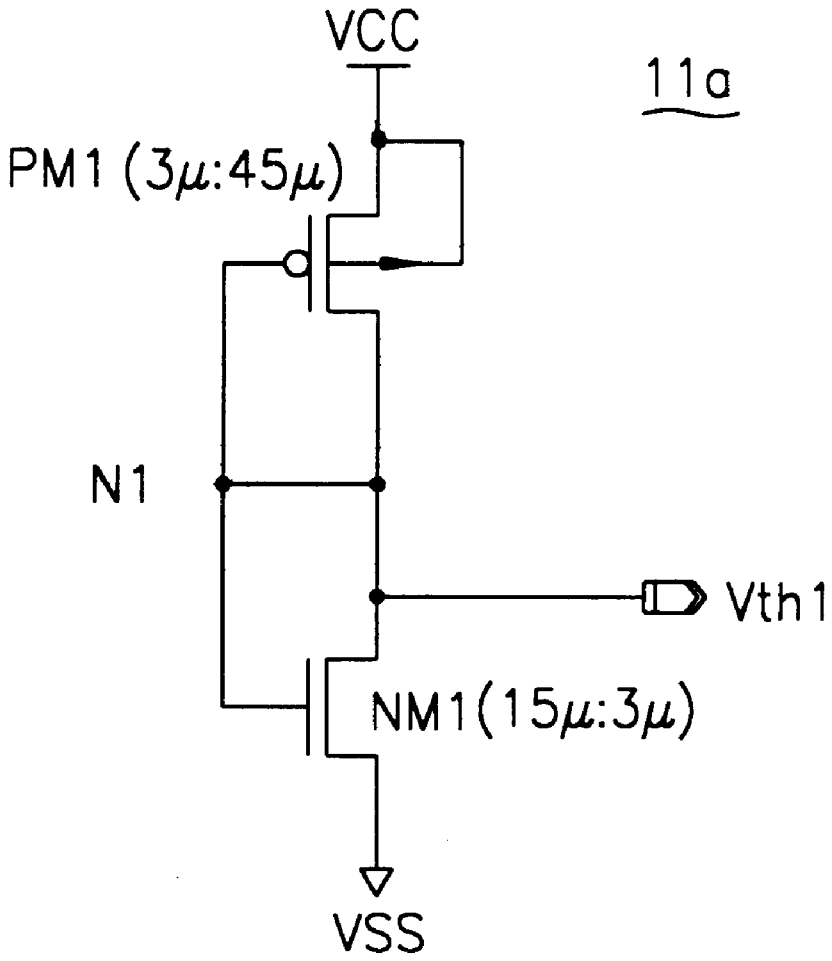
FIG. 6 CONVENTIONAL ART
FIG. 6 depicts a conventional inverter from a voltage generation circuit whose logic threshold voltage is plotted in FIG. 5.

In FIG. 5, the curve 52 represents the relation between VCC and the logic threshold voltage for inverter 70 of FIG. 7. Over the range of about 2 to 5 volts VCC, the slope of the curve 50 is much greater than the slope of the conventional curve 50. This indicates that the logic threshold of the inverter 70, Vt(70), is much more sensitive to ΔVCC than is Vt(11*a*), i.e., the conventional art. As a result, a substrate voltage circuit using the inverter 70 according to the present invention exhibits ΔVBB that is much less sensitive to ΔVCC than the conventional art.

Figure 8:
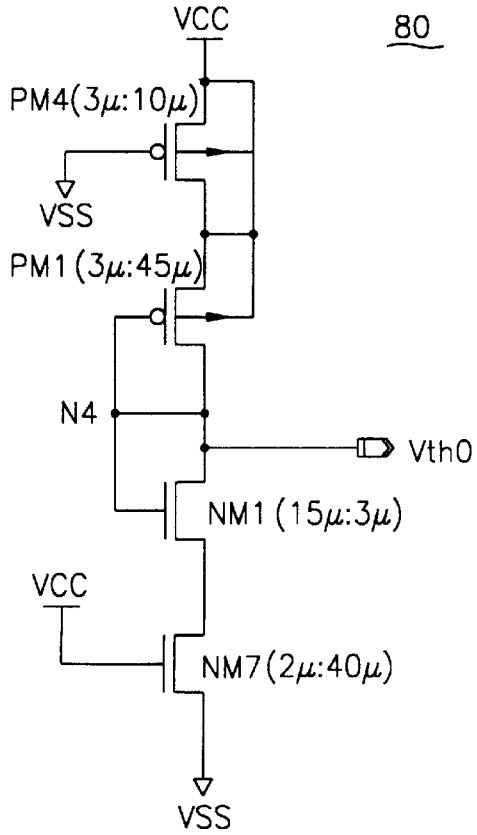

FIG. 8 illustrates the feature of incorporating additional active resistors into the inverter of the buffer. FIG. 8 illustrates a version 80 of the inverter 21 of FIG. 3. The inverter 80 has the same transistors PM1 and NM1 (and channel dimensions and ratios thereof, respectively) as the conventional inverter 11*a*, but incorporates the additional active resistors PM4 and NM7. The channel dimensions for these transistors are: PM4, 3 μm in width, 10 μm in length, for a ratio of 3:10; and NM7, 2 μm in width, 40 μm in length, for a ratio of 1:20.

In FIG. 5, the curve 54 represents the relation between VCC and the logic threshold voltage for inverter 80 of FIG. 8. Over the range of about 2 to 5 volts VCC, the slope of the curve 54 is greater than the slope of the conventional curve 50, although not as great as the slope of the curve 52 (corresponding to the embodiment of FIG. 7). This indicates that the logic threshold of the inverter 80, Vt(80), is more sensitive to ΔVCC than is Vt(11*a*), i.e., the conventional art. As a result, a substrate voltage circuit using the inverter 80 according to the present invention exhibits ΔVBB that is less sensitive to ΔVCC than the conventional art.

Figure 9:
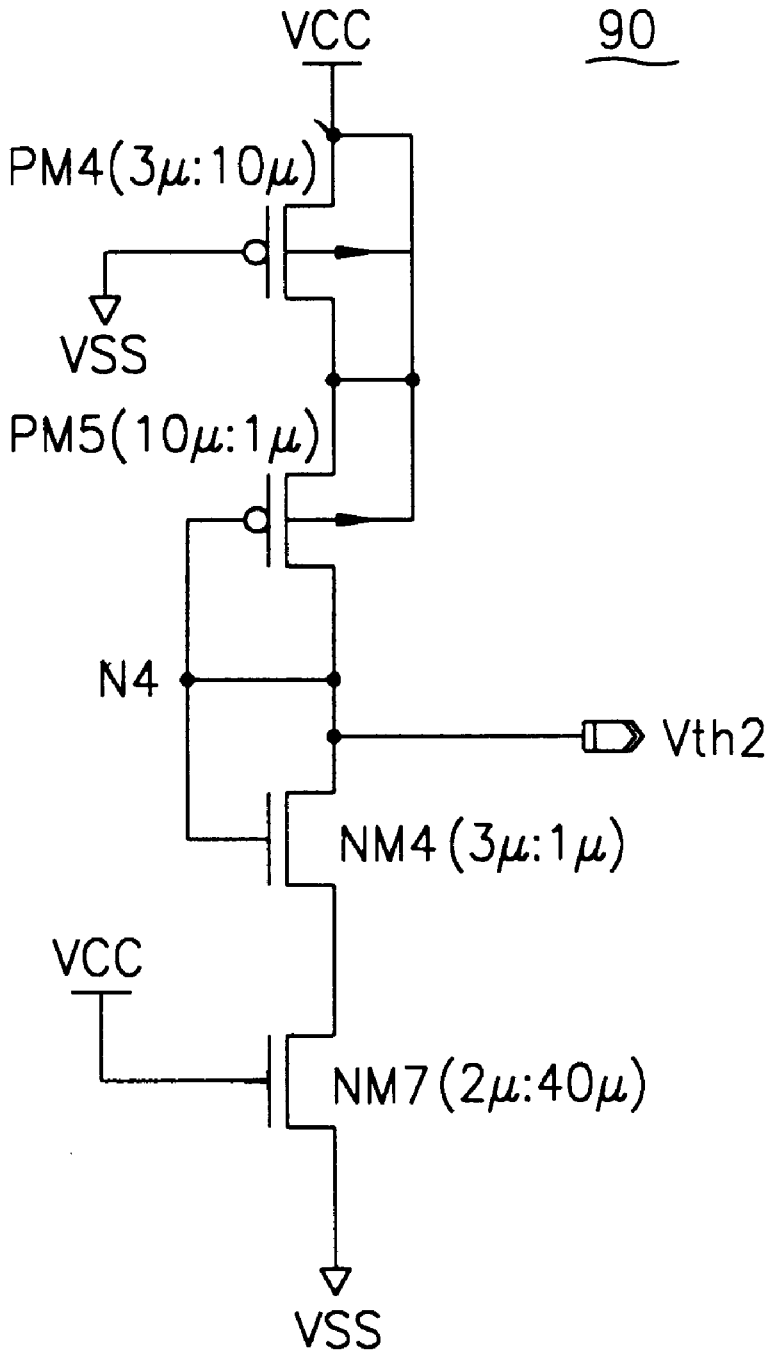

FIG. 9 illustrates both features of the present invention, i.e., the feature of adopting an opposite channel ratio arrangement for the inverter of the buffer vis-a-vis the conventional art, and the feature of incorporating additional active resistors into the inverter of the buffer. FIG. 9 illustrates a version 90 of the inverter 21 of FIG. 3. The inverter 90 has the transistors PM5 and NM4 of FIG. 7 (with their particular channel dimensions and ratios, respectively) and incorporates the additional active resistors PM4 and NM7 of FIG. 8 (with their particular channel dimensions and ratios, respectively).

In FIG. 5, the curve 56 represents the relation between VCC and the logic threshold voltage for inverter 90 of FIG. 9. Over the range of about 2 to 5 volts VCC, the slope of the curve 50 is much greater than the slope of the conventional curve 50, and greater than either of the curves 52 and 54 (corresponding to the embodiments of FIGS. 7 and 8, respectively) taken alone. This indicates that the logic threshold of the inverter 90, Vt(90), is much much more sensitive to ΔVCC than is Vt(11*a*), i.e., the conventional art. As a result, a substrate voltage circuit using the inverter 90 according to the present invention exhibits ΔVBB that is much much less sensitive to ΔVCC than the conventional art. To reiterate, it is preferred to have both features present as in FIG. 9, but it is not necessary. Rather, it is only necessary to have either the feature of adopting an opposite channel ratio arrangement for the inverter of the buffer vis-a-vis the conventional art (e.g., as in FIG. 7) or the feature of incorporating additional active resistors into the inverter of the buffer (e.g., as in FIG. 8) in order to practice the present invention.

Previously, it was indicated that the transistors NM3, NM5 and NM6 of FIG. 3 were optional. Under this option, the drain of the transistor PM5 would be connected to the node N5 and the drain of the transistor NM4 would be connected to the source of the transistor NMT. For example, the transistors NM5 and NM6 are optional because one transistor, i.e., NM7, can be figured to present the same conductance as three transistors. Nevertheless, it is more commercially expedient to use three transistors rather than one transistor. Thus, while optional, it is preferred that the transistors NM3, NM5 and NM6 be included when practicing the present invention.

The transistors NM5, NM6, and NM7 can be viewed as a load built into the inverter 21. Optimally, this load should be balanced with the load L4 of the detector circuit 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A substrate voltage generation circuit for a semiconductor memory device, the circuit comprising:

a substrate voltage detector for detecting a substrate voltage VBB;

a first inverter for inverting an output from said substrate voltage detector;

a second inverter for inverting an output from said first inverter;

an oscillator for oscillating in response to an output voltage from said second inverter; and a substrate voltage generator driven by an oscillation frequency from said oscillator for applying a substrate voltage to said substrate voltage detector;

a substrate voltage generator driven by an oscillation frequency from said oscillator for applying a substrate voltage to said substrate voltage detector;

said first inverter having a plurality of transistors, channels in said transistors being configured with ratios of width to length, respectively, that collectively produce a threshold voltage for said first inverter that varies substantially in accordance with a variation ΔVCC of a supply voltage VCC so as to minimize variations in said substrate voltage VBB relative to ΔVCC.

2. The circuit of claim 1, where said threshold voltage increases at least 100% over a range of VCC from 2–5 volts.

3. The circuit of claim 2, wherein said first inverter exhibits at least a 150% increase in said threshold voltage.

4. The circuit of claim 3, wherein said first inventor exhibits at least 188% increase in said threshold voltage.

5. The circuit of claim 1, where said inverter includes a plurality of transistors having resistance values that vary in accordance with said variation ΔVCC of said supply voltage VCC.

6. The circuit of claim 5, wherein said first inverter further comprises a PMOS transistor having a gate thereof connected for receiving a ground voltage and an NMOS transistor having a gate thereof connected for receiving the supply voltage and a source thereof connected to an output terminal of the first inverter.

7. The circuit of claim 5, wherein said plurality of transistors includes first, second and third NMOS transistors.

8. The circuit of claim 7, wherein said first through third transistors have the gates thereof connected for receiving said supply voltage and are connected with each other in series.

9. The circuit of claim 7, wherein said first inverter further comprises:

a first PMOS transistor a source of which receives said supply voltage and a gate of which is connected to ground;

a second PMOS transistor a source of which is connected with a drain of said first PMOS transistor, and a gate of said second PMOS transistor being connected with an output terminal of said substrate voltage detector;

a fourth NMOS transistor a drain of which is connected with a drain of said second PMOS transistor, a gate of said fourth NMOS transistor receiving said supply voltage, and a source of said fourth NMOS transistor being connected with an output terminal of said first inverter; and a fifth NMOS transistor a drain of which is connected with a source of said and a gate of said fifth NMOS transistor being connected with said output terminal of said detector;

said first through third NMOS transistors being connected in series between a source of said fifth NMOS transistor and ground, gates of said first through third NMOS transistors being connected for receiving said supply voltage, respectively.

10. A substrate voltage VBB generation circuit comprising:

a substrate voltage VBB fluctuation detector for detecting a fluctuation ΔVBB in said substrate voltage ΔVBB;

an oscillator;

an oscillator control circuit, connected between said detector and said oscillator, for controlling said oscillator to oscillate in accordance with a fluctuation ΔVCC in a supply voltage VCC; and a substrate voltage generator, connected to said oscillator and said detector, for generating VBB at least in part according to oscillation of said oscillator;

said oscillator control circuit including a buffer having a plurality of transistors, channels in said transistors being configured with ratios of width to length, respectively, that collectively produce a logic threshold voltage for said buffer that varies substantially in accordance with ΔVCC so as to minimize variations in said substrate voltage VBB relative to ΔVCC.

11. The circuit of claim 10, wherein said threshold voltage increases at least 100% over a range of VCC from 2–5 volts.

12. The circuit of claim 11, wherein said threshold voltage increases at least 150% over said range.

13. The circuit of claim 12, wherein said first inventor exhibits at least 188% increase in said threshold voltage.

14. The circuit of claim 10, wherein said buffer includes a first inverter and a second inverter, said first inverter being connected between said detector and said second inverter, said second inverter being connected between said first inverter and said oscillator.

15. The circuit of claim 14, wherein said detector includes a first load connected to VCC and a second load connected to said first load and said generator, said inverter being connected to said detector where said first load connects to said second load, said first inverter including a third load matched to said second load.

16. The circuit of claim 14, wherein said first inverter includes a first PMOS transistor connected in series to a first NMOS transistor, the gates of which are connected to said detector, respectively, wherein for each of said first PMOS and first NMOS transistors, the channel width (W) is greater than the channel length (L).

17. The circuit of claim 16, wherein said first inverter further includes a second PMOS transistor and a second NMOS transistor, said second PMOS transistor being configured as an active resistor between said first PMOS transistor and VCC, said second NMOS transistor being configured as an active resistor between said first NMOS transistor and ground.

18. The circuit of claim 17, wherein for said second PMOS and second NMOS transistors, the channel width (W) to channel length (L) ratios (W:L) are opposite.

19. The circuit of claim 17, wherein said first inverter further includes third NMOS and fourth NMOS transistors configured as active resistors and connected serially between said first NMOS transistor and said second NMOS transistor.

20. The circuit of claim 18, wherein said second PMOS transistor has a W:L of W>L and said second NMOS transistor has a W:L ratio of W<L.

21. The circuit of claim 14, wherein said first inverter includes a first PMOS transistor connected in series to a first NMOS transistor, the gates of which are connected to said detector, respectively, said inverter further including a second PMOS transistor and a second NMOS transistor, said second PMOS transistor being configured as an active resistor between said first PMOS transistor and VCC, said second NMOS transistor being configured as an active resistor between said first NMOS transistor and ground.

22. The circuit of claim 21, wherein for said second PMOS and second NMOS transistors, the channel width (W) to channel length (L) ratios (W:L) are opposite.

23. The circuit of claim 21, wherein said first inverter further includes third NMOS and fourth NMOS transistors configured as active resistors and connected serially between said first NMOS transistor and said second NMOS transistor.

24. The circuit of claim 22, wherein said second PMOS transistor has a W:L of W>L and said second NMOS transistor has a W:L ratio of W<L.

* * * * *